US006325309B1

(12) United States Patent
Chang

(10) Patent No.: US 6,325,309 B1
(45) Date of Patent: Dec. 4, 2001

(54) GEAR PROTECTION DEVICE OF A PAPER SHREDDER

(76) Inventor: Frank Chang, 3rd Fl., 200, Sin-Yi Rd., Sec. 3, Taipei (TW)

( * ) Notice: Subject to any disclaimer, the term of this patent is extended or adjusted under 35 U.S.C. 154(b) by 0 days.

(21) Appl. No.: 09/571,600

(22) Filed: May 15, 2000

(51) Int. Cl.[7] ..... B02C 4/42
(52) U.S. Cl. ..... 241/32; 241/101.2; 241/236
(58) Field of Search ..... 241/32, 236, 100, 241/101.2

(56) References Cited

U.S. PATENT DOCUMENTS 4,560,110 * 12/1985 Burda ..... 241/32
5,518,190 * 5/1996 Aebi et al. ..... 241/32

FOREIGN PATENT DOCUMENTS

3545314 * 7/1987 (DE) .

* cited by examiner

*Primary Examiner*—Mark Rosenbaum
(74) *Attorney, Agent, or Firm*—Dougherty & Troxell

(57) ABSTRACT

This invention is related to a gear protection device of a paper shredder. The gearbox of the paper shredder is provided with a transmission component having a safety trip and with an adjustable transmission load. The device is provided on an end face of a primary gear driven by an output shaft of a motor, which end face is provided with a radial teethed face that couples to an end face of a secondary gear being provided with another radial teethed face. The primary and second gears are serially connected on a central shaft. Another end of the secondary gear is formed with a male gear engaging and being driven by another gear mechanism. Another end of the primary gear is provided with an adjustable transmission load structure that comprises a compression spring, a bearing, and a screw for adjusting to an appropriate force between the primary and second gears, whereby when the transmission load being subjected to the secondary gear is greater than such a force, retreating of the spring after compression causes the primary and secondary gears to trip away from each other such that the friction only extends to the radial awl teethed faces so as to effectively protect the motor as well as other gearboxes.

3 Claims, 4 Drawing Sheets

GEAR PROTECTION DEVICE OF A PAPER SHREDDER

SUMMARY OF INVENTION

This invention is related to a gear protection device of a paper shredder. The gearbox of the paper shredder is provided with a transmission component having a safety trip and with an adjustable transmission load. The device is provided on an end face of a primary gear driven by an output shaft of a motor, which end face is provided with a radial teethed face that couples to an end face of a secondary gear being provided with another radial teethed face. The primary and second gears are serially connected on a central shaft. Another end of the secondary gear is formed with a male gear engaging and being driven by another gear mechanism. Another end of the primary gear is provided with an adjustable transmission load structure that comprises a compression spring, a bearing, and a screw for adjusting to an appropriate force between the primary and second gears, whereby when the transmission load being subjected to the secondary gear is greater than such a force, retreating of the spring after compression causes the primary and secondary gears to trip away from each other such that the friction only extends to the radial awl teethed faces so as to effectively protect the motor as well as other gearboxes.

Paper shredders are used to prevent leakage of printed information such that confidential information can be diminished along with the paper after passing through the paper shredders. Conventional paper shredders each include a motor that drives a rolling blade through a gearbox such that the blade edge (in a tined or serrated form) grips the paper and then shreds the paper into strips or fragments.

During the entire shredding process, the resistance caused by the shredded paper may be fed-back to the gearbox and, thus, damage the tiny gears within the gearbox under the continuous power output of the motor and eventually due to overwhelming torque. The entire transmission system will then become malfunctioned due to a single damaged gear.

One cause for damaging the gears may be that a user inserts more paper than the paper shredder can handle at a time thereby overloading the roller blade. Though such a type of damage resulting from improper uses cannot be imputed to the paper shredders, the manufacturer of the paper shredders should be obligated to design the paper shredders that can prevent damages resulting from such improper uses so as to prolong the life cycle and to enhance the quality of the paper shredders.

In view of the above, the "gear protection device of a paper shredder" of this invention is invented in an attempt to solve the above problems after diligent trials and researches.

It is thus a primary object of this invention to provide a gear protection device of a paper shredder that includes a clutching component made of abrasion-resistant materials. The device is automatically tripped when encountering overwhelming feedback resistance caused by the shredded paper, such that the entire gearbox and blade assembly can be temporarily free from the driving force of the motor when the motor is still in operation so as to prevent from damaging the gears and the blade due to overloading. In addition, the electric motor can be prevented from burning out due to overloading or elevating voltage.

In order to clearly delineate the objects, characteristics and advantages of the present invention, a few preferred embodiments are specifically explained in detail in accompany with the drawings as follows.

DETAILED DESCRIPTIONS OF EMBODIMENTS

Figure 1:
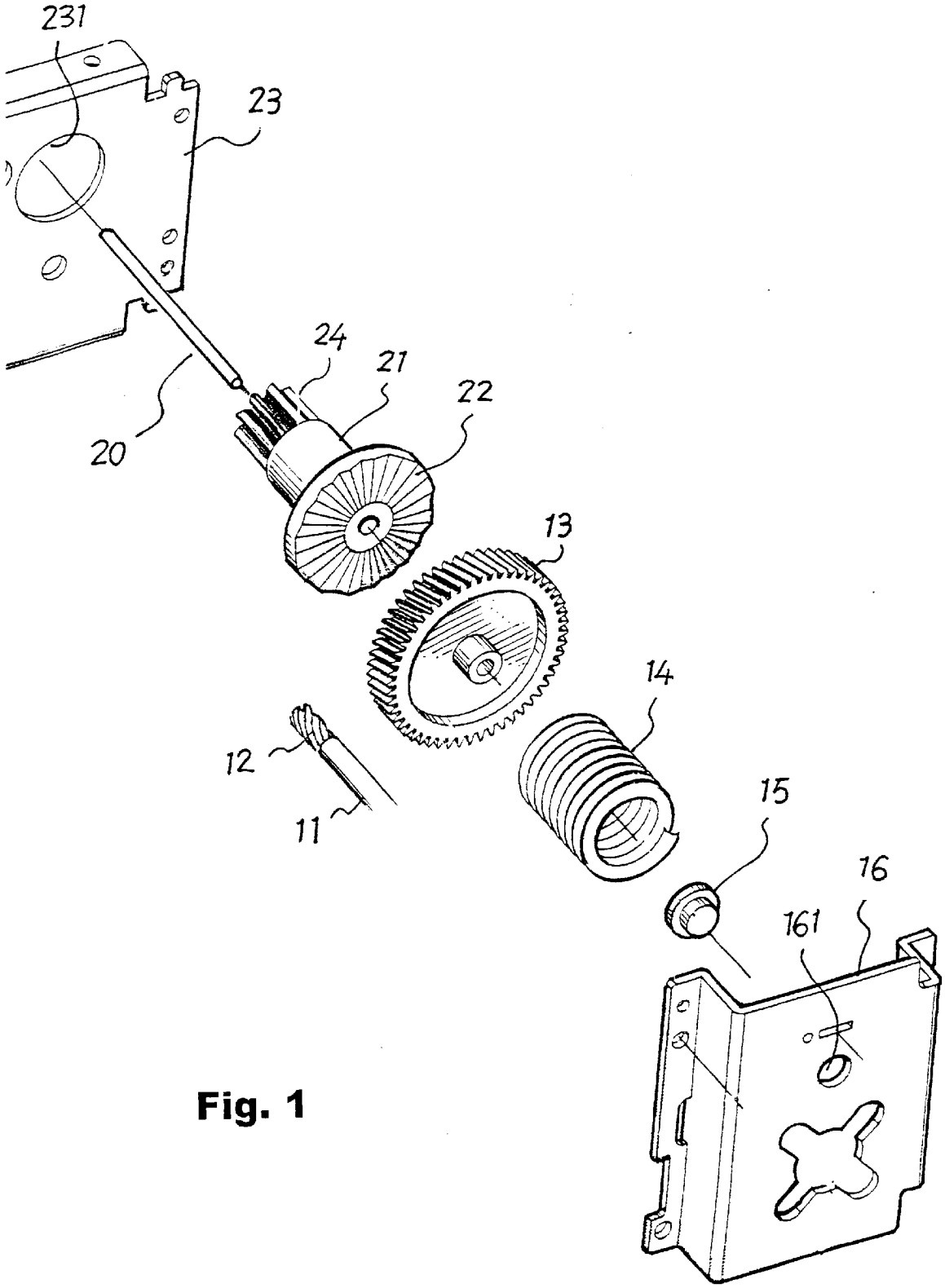
FIG. 1 is an assembled, cross-sectional view of a driving mechanism of a first embodiment of this invention.

This invention is related to a gear protection device of a paper shredder which divides the gearbox of the paper shredder into a first driving set 1 and a second driving set 2, between which sets are featured with an auto-tripping transmission component, that includes meshable and detachable radial awl faces 19, 22 provided between a primary gear 13 and a secondary gear 21, in accompaniment with a central shaft 20, a spring 14, and a adjustable transmission load structure for adjusting the load the device may undertake.

Figure 2:
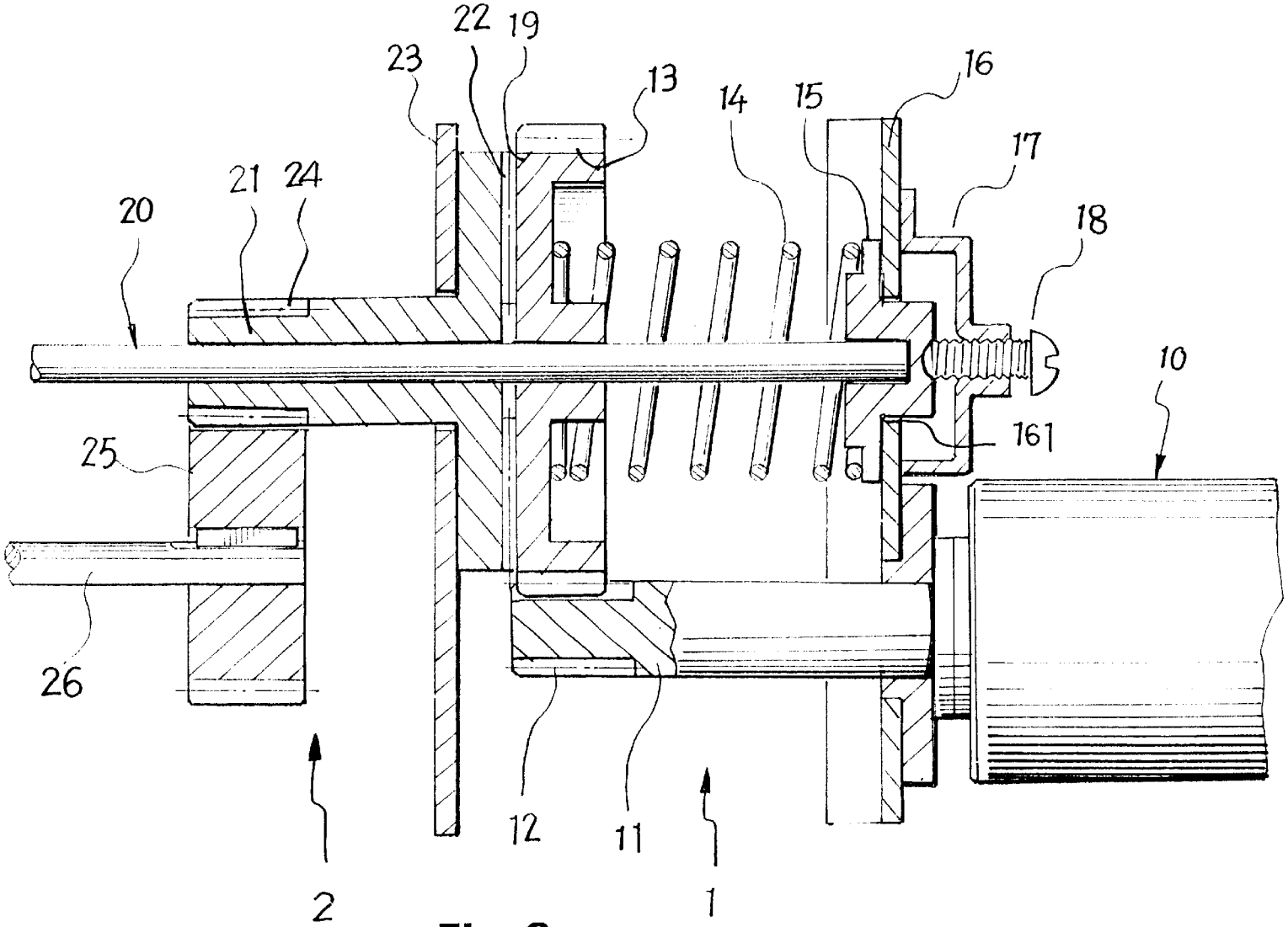
FIG. 2 is an exploded, perspective view of the first embodiment of this invention.

As shown in FIGS. 1 and 2 illustrating the first embodiment according to this invention, the device is provided on an end face of the primary gear 13 driven by a small gear 12 of an output shaft 11 of a motor 10. The first driving set 1 is featured with a radial awl teethed face 19 provided on the end face of the primary gear 13, and a spring 14, an end bearing 15, and an end base 16 provided on another end face of the primary gear 13 such that tension of the spring 14 after compression is exerted on to the end face of the primary gear 13. The radial awl teethed face 19 couples to a radial awl teethed face 22 of the secondary gear 21 so as to allow driving or tripping effects. The secondary gear 21 has a T-shaped cross-section. The second driving set 2 is featured with the radial awl teethed face 22 formed on its larger end of the secondary gear 21 and a transmission gear 24 on another end face. The primary gear 13 and the secondary gear 21 are both serially connected on the central shaft 20 such that the driving force from the output shaft 11 of the motor 10, under normal operation, is transmitted through the small gear 12, the primary gear 13, and the radial awl teethed face 19 to drive the radial awl teethed face 22 of the secondary gear 21, which driving force is then transmitted through the transmission gear 24 provided on another end and other gear mechanisms 25, 26 to the blade wheel (not shown) of the paper shredder.

Figure 5:
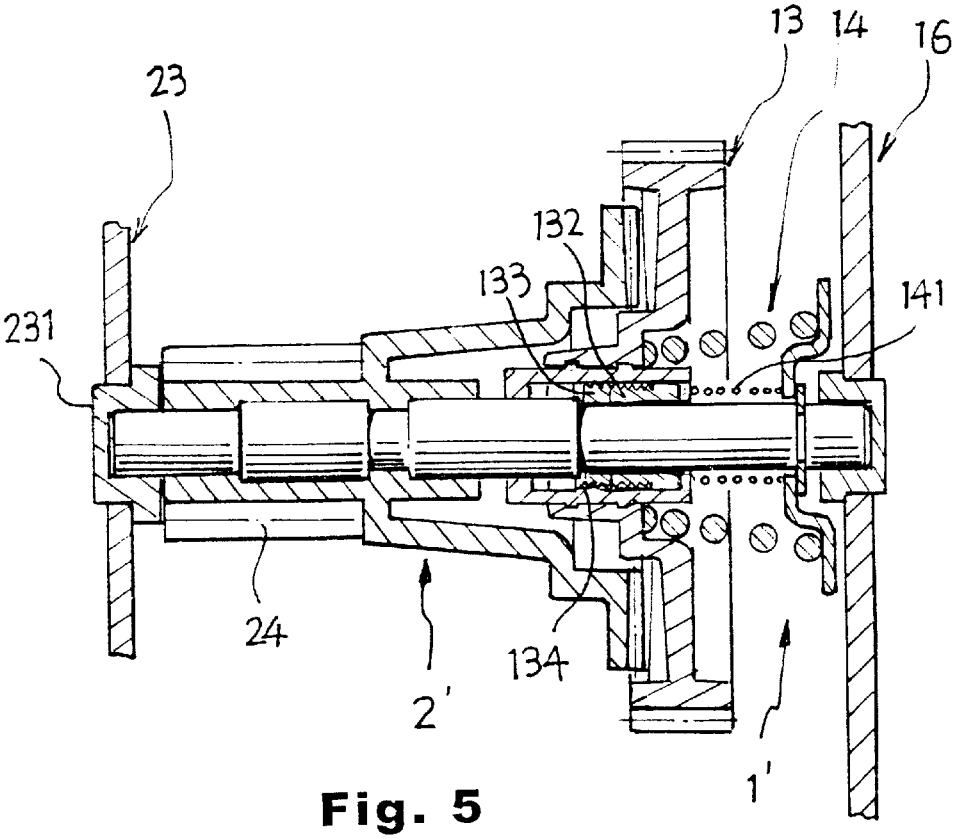
FIG. 5 is an assembled, cross-sectional view showing the state of tripping of the second embodiment of this invention.

However, when the resistance exerted by the blade wheel exceeds the acceptable setting (occurred while gripping more paper than the paper shredder can handle or gripping non-paper, rigid objects) so as to overwhelm the gearbox and the motor, the resistance of the blade wheel increases the counter transmission resistance of the second driving set 2 of the secondary gear 21 to exceed the output force of the first driving set 1 and to exceed the static tension of the spring 14; subsequently, resilience of the spring 14 will then cause the radial awl teethed face 19 that originally meshes with the radial awl teethed face 22 between the primary and secondary gears 13, 21, to detach from the radial awl teethed face 22 one tooth by one tooth (see FIG. 5). Under such a circumstance, the secondary gear 21 is no longer driven by its meshing effect with the primary gear 13, thereby ceasing rotation of the gearbox and blade that is driven by the secondary gear 21. Though the primary gear 13 is still driven by the motor 10 and is still in operation, the device prevents the entire gearbox and the blade from overloading and damages, and prevents the motor 10 from halting due to obstructions or from burning out due to elevated voltage.

The tension of the spring 14 can further be adjustable. As shown in FIG. 2, the bearing 15 includes a relatively larger flange for retaining an end portion of the spring 14 to the flange. The end base 16 includes a bearing opening 161 and a projecting base 17 that is formed at a center with a screw opening for receiving an adjusting screw 18 that urges against center of the end of the bearing 15. Rotation of the adjusting screw 18 will urge against the spring 15 and change (increase) the force that the primary gear 13 exerts on the secondary gear 21 so as to control the tripping resistance of the primary gear 13.

Figure 3:
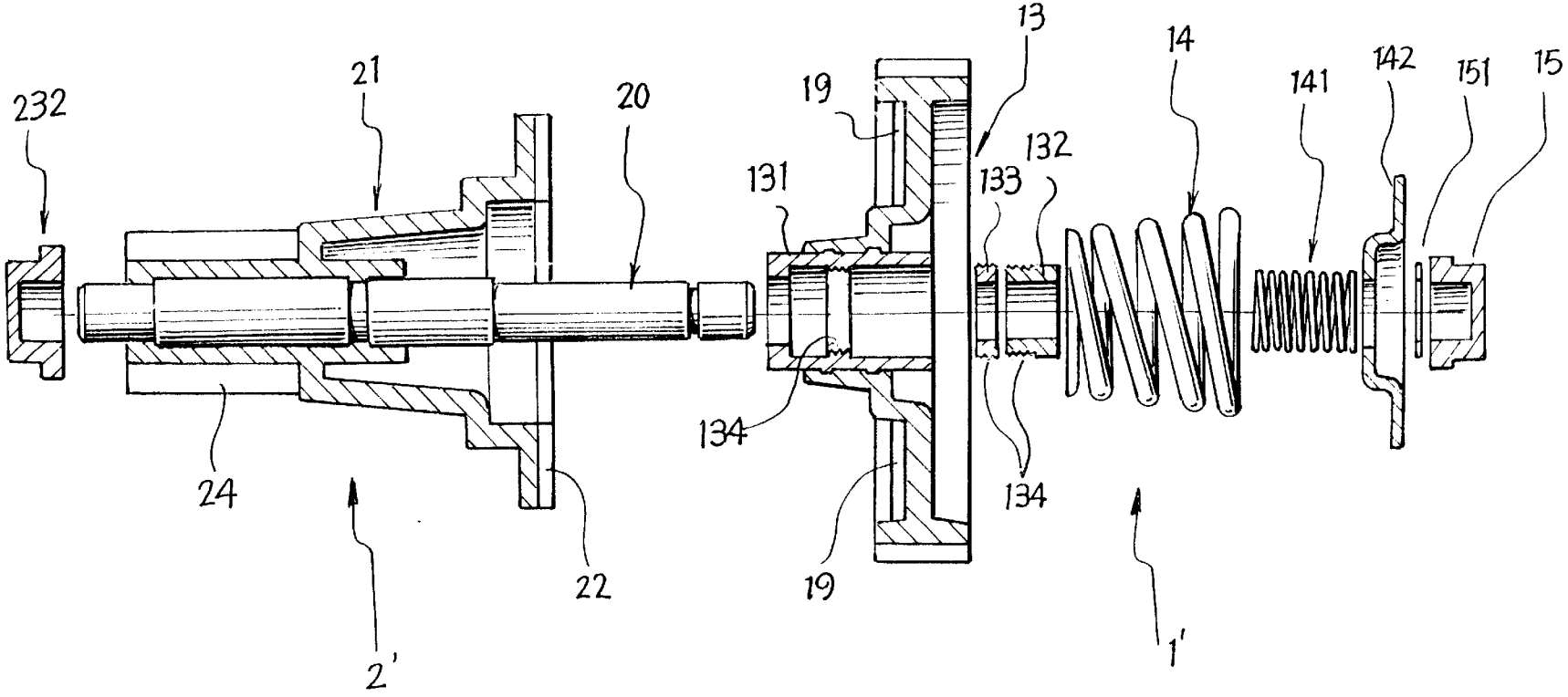
FIG. 3 is an exploded, cross-sectional view of a second embodiment of this invention.
Figure 4:
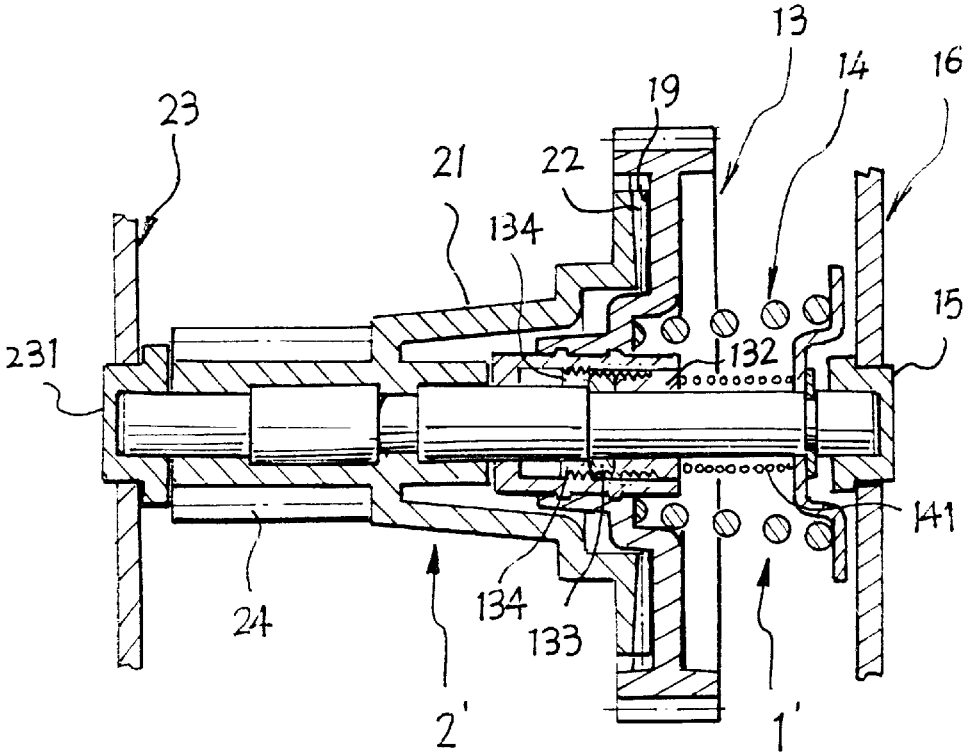
FIG. 4 is an assembled, cross-sectional view showing the state of normal operation of the second embodiment of this invention.

Using identical concepts of engaging radial teethed faces and auto-tripping while encountering resistance, a second embodiment that does not generate constant, clicking sound during the tripping operation is invented by the inventor. FIGS. 3, 4, and 5, respectively, illustrate an exploded, cross-sectional view, the assembled, cross-sectional view showing the state of normal operation, and the assembled, cross-sectional view showing the state of tripping of the second embodiment of this invention. Similarly, the device divides the gearbox of the paper shredder into a first driving set 1' and a second driving set 2'. The meshable and detachable radial awl faces 19, 22 are also provided between the primary gear 13 and the secondary gear 21. What distinguishes this embodiment from the previous one is the primary gear 13 is configured to a horn shape that has an end being provided with the radial awl teethed face 19. Within the horn of the primary gear 13 is provided with the spring 14 and an inner liner 131. The inner liner 131 is formed with a section of inner threads 134 that correspond to two threaded rings 132, 133. The threaded rings 132, 133 telescopically engage the inner liner and allow sliding movement with respect to the central shaft 20. The threaded rings 132, 133 are compressed by a slender spring 141. The slender spring 141 is retained to a spring retaining base 142 located on another end so as to urge against the threaded ring 132. The previous spring 14 extends between the primary gear 13 and the spring retaining base 142. The spring retaining base 142 is secured to the central shaft 20 at a location adjacent the gearing 15 via a gasket 15.

As shown in FIG. 4, under normal operation, the driving force of the output shaft 11 (not shown) of the motor 10 is transmitted through the small gear 12, the primary gear 13, and the radial awl teethed face 19 to drive the radial awl teethed face 22 of the secondary gear 21, which driving force is then transmitted through the transmission gear 24 provided on another end and other gear mechanisms to the blade wheel of the paper shredder so as to perform the shredding operation.

As shown in FIG. 5, when the resistance exerted by the blade wheel exceeds the acceptable setting so as to overwhelm the gearbox and the motor, the resistance of the blade wheel increases the counter transmission resistance of the second driving set 2' of the secondary gear 21 to exceed the output force of the first driving set 1 and to exceed the static tension of the spring 14 and the slender spring 141; subsequently, resilience of the spring 14 will then cause the radial awl teethed face 19 that originally meshes with the radial awl teethed face 22 between the primary and secondary gears 13, 21 to retract and to detach from the radial awl teethed face 22 at the first tooth, that is, the primary gear 13 retracts backwards, whereas rotation of the primary gear 13 continues during the retraction operation, so as to enable threading engagement between the threaded rings 132, 133 and the inner threads 134 due to compression of the slender spring 141. Once achieving the threading engagement, the entire primary gear 13, after the retraction and rotation, is temporarily retained to the threaded rings 132, 133 so as to detach from the secondary gear 21 whereby the primary and the secondary gears are no longer in contact with one another without generating the clicking sound as a result of the tripping effects between the radial teethed face 19 and the radial teethed face 22. To return the primary gear to its original state, the motor is switched to rotate in a reverse direction (such as the measure conventionally adopted in known paper shredders while encountering paper jamming) such that the primary gear is able to recede along the threading direction of the inner threads 134 and the threaded rings 132, 133 so as to return to its original state.

This invention provides a gear protection device of a paper shredder including a clutching component made of abrasion-resistant materials. The device is automatically tripped when encountering overwhelming feedback resistance caused by the shredded paper, such that the entire gearbox and blade assembly can be temporarily free from the driving force of the motor when the motor is still in operation so as to prevent from damaging the gears and the blades due to overloading. In addition, the electric motor can be prevented from burning out due to overloading or elevating voltage. This invention is thus a valuable improvement. A patent is hereby submitted and patent rights are respectfully solicited to be granted thereto.

What is claimed is:

1. A gear protection device of a paper shredder, the device dividing gear box of the paper shredder into a first driving set and a second driving set, between which sets are featured with an auto-tripping transmission component to allow automatic, tripping effect when the feedback resistance of shredded paper exceeds an acceptable setting such that a gearbox and a blade assembly are temporarily free from driving force of a motor when the motor is still in operation, the gearbox including a primary gear driven by a small gear of an output shaft of the motor, and a secondary gear driven by the primary gear and transmitting the driving force to the blade assembly of the paper shredder, between which gears are featured with the auto-tripping device that trips in response to over-resistance, characterized in that, the device including a radial awl teethed face provided on an end face of the primary gear, a spring, an end bearing, and an end base provided on another end face of the primary gear such that tension of the spring after compression is exerted on the end face of the primary gear; the radial awl teethed face couples to a radial awl teethed face formed on an end face of the secondary gear so as to allow driving or tripping effect, the secondary gear being provided with a transmission gear on another end face thereof; the primary gear and the secondary gear are both serially connected on a central shaft such that the driving force from the output shaft of the motor, under normal operation, is transmitted through the small gear, the primary gear, and the radial awl teethed face to drive the radial awl teethed face of the secondary gear, which driving force is then transmitted through the transmission gear provided on another end of the secondary gear and other gear mechanisms to the blade wheel of the paper shredder, whereby when the resistance exerted by the blade wheel exceeds the acceptable setting so as to overwhelm the gearbox and the motor, the resistance of the blade wheel increases the counter transmission resistance of the second driving set of the secondary gear to exceed the output force of the first driving set and to exceed the static tension of the spring, such that resilience of the spring causes the radial awl teethed face that originally meshes with the radial awl teethed face between the primary and secondary gears to detach from the radial awl teethed face one tooth by one tooth, thereby ceasing rotation of the gears and the blade assembly subsequent to the secondary gear due to external resistance.

2. The gear protection device of a paper shredder as set forth in claim 1, wherein the primary gear is configured to a horn shape, that has an end being provided with the radial awl teethed face, within the horn of the primary gear being provided with the spring and an inner liner within a central opening thereof, wherein the inner liner is formed with a section of inner threads that correspond to two threaded rings, the threaded rings telescopically engaging the inner liner and allowing sliding movement with respect to the central shaft; the threaded rings are compressed by a slender spring, the slender spring being retained to a spring retaining base located on another end so as to urge against the inner threaded ring; the said spring extends between the primary gear and the spring retaining base; and the spring retaining base is secured to the central shaft at a location adjacent the gearing via a gasket, whereby when the resistance exerted by the blade wheel exceeds the acceptable setting, resilience of the spring causes the radial awl teethed face to retract and to detach from the radial awl teethed face at the first tooth, that is, the primary gear retracts backwards, whereas rotation of the primary gear continues during the retraction operation, so as to enable threading engagement between the threaded rings and the inner threads due to compression of the slender spring; under the threading engagement, the entire primary gear, after the retraction and rotation, is temporarily retained to the threaded rings so as to detach from the secondary gear, such that the primary and the secondary gears are no longer in contact with one another without generating clicking sound that may result from the tripping effects between the radial teethed face and the radial teethed face; to return the primary gear to its original state, the motor is switched to rotate in a reverse direction such that the primary gear is able to recede along the threading direction of the inner threads and the threaded rings so as to return to its original state.

3. The gear protection device of a paper shredder as set forth in claim 1 wherein the bearing includes a relatively larger flange for retaining an end portion of the spring to the flange, the end base including a bearing opening and a projecting base that is formed at a center with a screw opening for receiving an adjusting screw that urges against center of the end of the bearing, whereby rotation of the adjusting screw urges against the spring and changes a force that the primary gear exerts on the secondary gear so as to allow adjustment of the tension of the spring.

* * * * *